United States Patent [19]

Ingham

[11] 3,942,024

[45] Mar. 2, 1976

[54] AUTOMOBILE ENGINE WARMER

[76] Inventor: Dickey E. Ingham, 522 Plumer St., Oil City, Pa. 16301

[22] Filed: Oct. 11, 1974

[21] Appl. No.: 514,098

[52] U.S. Cl. ..... 290/38 R; 307/10 R; 290/37 R

[51] Int. Cl.[2] ..... H02P 9/04

[58] Field of Search ..... 307/10 R; 290/37, 38, 39, 290/40

[56] References Cited

UNITED STATES PATENTS

| | | | |
|---|---|---|---|
| 2,650,987 | 9/1953 | Doyle | 307/10 R |
| 2,991,370 | 7/1961 | Sutton | 290/38 R |
| 3,443,557 | 5/1969 | Hebert | 290/38 R |
| 3,740,564 | 6/1973 | Wong | 290/37 |

*Primary Examiner*—Herman J. Hohauser

[57] ABSTRACT

A mechanism and circuit is disclosed for starting an automobile engine automatically at a predetermined time. The mechanism includes a timer which can be set to operate starting at a certain time, for example, to operate from 7:45 A.M., thus the automobile will be warm and ready for a trip at, say 8:00 A.M. An operation timer is provided to shut off the engine after a predetermined time, for example, ten minutes and a thermostat is provided which will shut off the engine when the automobile has reached the desired temperature.

1 Claim, 1 Drawing Figure

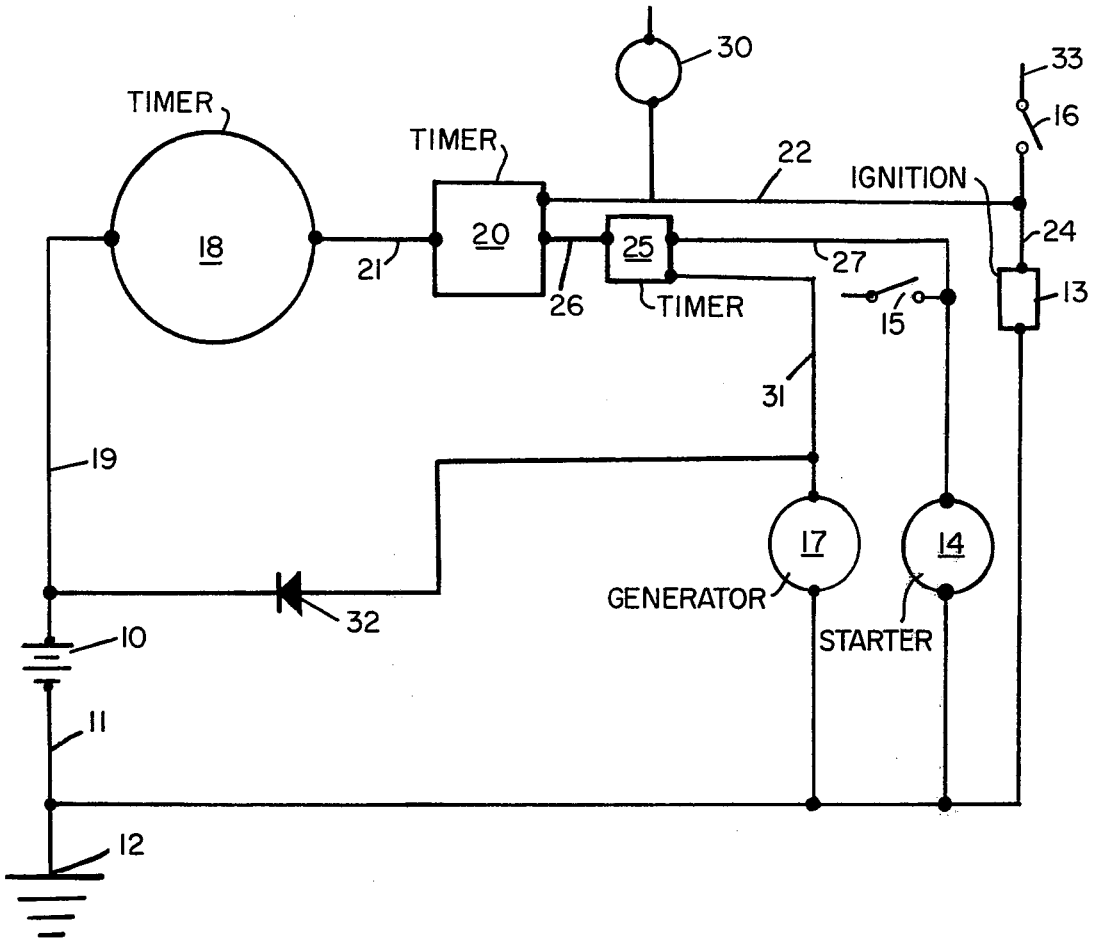
30
33
16
TIMER
TIMER
22
IGNITION
18
20
25
24
21
27
13
26
TIMER
15
31
19
17
14
GENERATOR
32
STARTER
10
11
12

AUTOMOBILE ENGINE WARMER

REFERENCE TO PRIOR ART

The invention disclosed herein is an improvement over U.S. Pat. No. 3,053,989, which shows an automobile starting circuit which will start an automobile engine at fixed time intervals.

OBJECTS OF THE INVENTION

It is an object of the invention to provide an improved automobile starting device.

Another object of the invention is to provide an automobile starting device that is simple in construction, economical to manufacture, and simple and efficient to use.

Another object of the invention is to provide an improved automobile starting device.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWING

The drawing shows an example of a circuit which will carry out the objects of the present invention.

DETAILED DESCRIPTION OF THE DRAWING

The drawing discloses an automobile starting circuit. The automobile has the conventional battery 10 having one terminal wire 11 connected to a ground 12. The automobile has the conventional ignition circuit 13 and starter motor 14 and a conventional starter switch 15 and conventional ignition switch 16. The starter switch 15 will normally operate in conjunction with the ignition switch 16 to start the engine in a conventional manner. The automobile likewise has a generator or alternator 17 for charging the battery 10 with a suitable cutout 32. As used herein the word generator is intended to cover both a generator and/or alternator.

The timer 18 is connected from the battery 10 by way of wire 19 to the integral timer 20 by way of wire 21. The integral timer 20 has suitable internal contacts of the type familiar to those skilled in the art to connect to wire 21 to the ignition circuit 13 through wire 22.

To protect the battery if the engine fails to start, the timer 25 is provided. The timer 25 is connected by wire 26 back to the timer 20 and to starter motor 14. Timer 25 opens after cranking the motor say 60 seconds. The timer 25 is likewise controlled by the generator or alternator 17 so that the timer 25 will disconnect from the wire 27 when the voltage from the generator or alternator 17 indicates that the engine has started. Generator voltage stops timer 25 and disconnects wire 27 from the starter motor 14 when the engine starts.

It will be noted that in order to operate the device shown, the operator sets the timer 18 at a time, say 15 minutes before the time he intends to start his next trip. The timer 18 is of a type familiar to those skilled in the art and may be of the type frequently used for watering lawns or turning lights on or off at predetermined times. The operator sets the timer 20 for the time he wishes the engine to start to warm up the automobile. The timer 25 will be set for, say 60 seconds, so that the starter motor will not operate more than 60 seconds if the engine fails to start, thereby protecting the battery 10. The ignition switch 16 of the automobile will be normally turned off. The automobile heater and defroster motor 30 will be connected to the line 22. Thus, when 60° F. set on the timer 18 reaches the predetermined time setting, it will energize line 21 which will in turn through the timer 20 and timer 25 energize starter motor 14. When the automobile engine starts, the generator or alternator 17 will produce a voltage in line 31 and cause the element 25 to deenergize wire 27 disconnecting the battery 10 from the starter motor 14. The circuit is connected at 33 to automobile ignition switch 16 and the starter switch 15 will be manually turned off.

The device is one which will operate without a key. This permits the owner of the car to remove the key from the ignition and lock his car as a safety measure.

When the car owner leaves the vehicle, he sets the timer and also sets the other devices which, for instance, he turns on the heater, if he wants the car to be heated, or he turns on the cooling system if he wishes the car to be air conditioned. If he does not take these steps the only thing that would effect the engine would be in operation.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A starting device in combination with an automobile having an ignition system, a starter motor, a generator or alternator, a battery, and a heater motor, a first timer and a second timer and a third timer, said first timer, said second timer, and said third timer being connected in series with each other, said third timer having first means connected to said generator and second means connected to said starter motor, said first timer and said second timer being connected in series with said autombile ignition system, said first timer having means thereon to complete said series circuit from said battery to said second timer at a predetermined time, said second timer being connected to means on said first timer to actuate said second timer connecting said ignition system to said battery through said first timer and connecting said second timer to said battery through said first timer for a predetermined time, said third timer being adapted to connect said starter motor to said battery for a predetermined time determined by said first timer and said second timer when said second timer is actuated and, means on said third timer connected to said generator for disconnecting said starter motor from said battery when said generator produces a voltage of a predetermined value.

* * * * *